US006231146B1

(12) United States Patent
Dang

(10) Patent No.: US 6,231,146 B1
(45) Date of Patent: May 15, 2001

(54) REFRIGERATOR DOOR BOTTOM STORAGE MODULE ASSEMBLY

(75) Inventor: Muc Dang, Burlington (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/441,744

(22) Filed: Nov. 17, 1999

(30) Foreign Application Priority Data

Sep. 24, 1999 (CA) ..... 2283549

(51) Int. Cl.[7] ..... A47B 96/04
(52) U.S. Cl. ..... 312/405.1; 312/321.5
(58) Field of Search ..... 312/405.1, 405, 312/401, 321.5, 138.1, 116, 351, 245, 242; 108/108, 110; 211/187, 90.01, 88, 153; 62/377

(56) References Cited

U.S. PATENT DOCUMENTS

| | | | | |
|---|---|---|---|---|
| Re. 34,377 | | 9/1993 | Wilkins et al. | 312/245 |
| 3,220,558 | * | 11/1965 | Olsson | 312/405.1 X |
| 3,227,502 | | 1/1966 | Roberts . | |
| 3,682,521 | | 8/1972 | Kesling . | |
| 3,807,822 | | 4/1974 | Amore . | |
| 4,801,182 | | 1/1989 | Metcalfe et al. | 312/309 |
| 4,859,010 | | 8/1989 | Jeziorowski | 312/312 |
| 4,908,544 | | 3/1990 | Lau | 312/321.5 |
| 5,004,305 | | 4/1991 | Montuoro . | |
| 5,042,398 | | 8/1991 | Lau et al. | 108/108 |
| 5,226,717 | | 7/1993 | Hoffman | 312/405.1 |
| 5,322,366 | | 6/1994 | Revlett et al. | 312/405.1 |
| 5,346,299 | | 9/1994 | Werkmeister et al. | 312/405.1 |
| 5,370,455 | | 12/1994 | Sedovic et al. | 312/405.1 |
| 5,375,924 | | 12/1994 | Pohl et al. | 312/405.1 |
| 5,567,029 | | 10/1996 | Haenisch et al. | 312/405.1 |
| 5,685,624 | * | 11/1997 | Lee | 312/405.1 |

FOREIGN PATENT DOCUMENTS

| | | | | |
|---|---|---|---|---|
| 9305362 | | 9/1995 | (BR) . | |
| 1105892 | * | 5/1961 | (DE) | 312/405.1 |
| 851667 | | 10/1960 | (GB) . | |
| 2176884 | | 1/1987 | (GB) . | |
| 43 17 615 | | 12/1994 | (GB) . | |

* cited by examiner

*Primary Examiner*—James O. Hansen

(57) ABSTRACT

A refrigerator door bottom storage module assembly extending across the refrigerator door. The refrigerator door has an inner liner having side walls, a bottom wall and a rear wall defining a liner recess. The bottom wall has a forward lower landing and a stepped raised landing extending into the liner recess rearwardly of the forward lower landing. Aligned module supporting bosses project inwardly of each of the side walls. A door storage module has a pair of spaced apart module side walls positionable adjacent the liner side walls. The module has a front wall extending between the module side walls and a supporting floor extending rearwardly of the front wall. The module side walls have a pair of spaced apart ribs vertically projecting to define an open recess. The module is assembled to the door by sliding the module ribs over the bosses until the supporting floor of the module is seated upon the forward lower landing of the bottom wall of the inner liner. Consequently, any articles supported by the bottom support module are seated upon the supporting floor of the module which at least partially rests on the forward lower landing of the bottom wall of the door inner liner. The amount of vertical loading on the liner side walls is significantly less than the loading onto the bottom wall of the door inner liner.

16 Claims, 2 Drawing Sheets

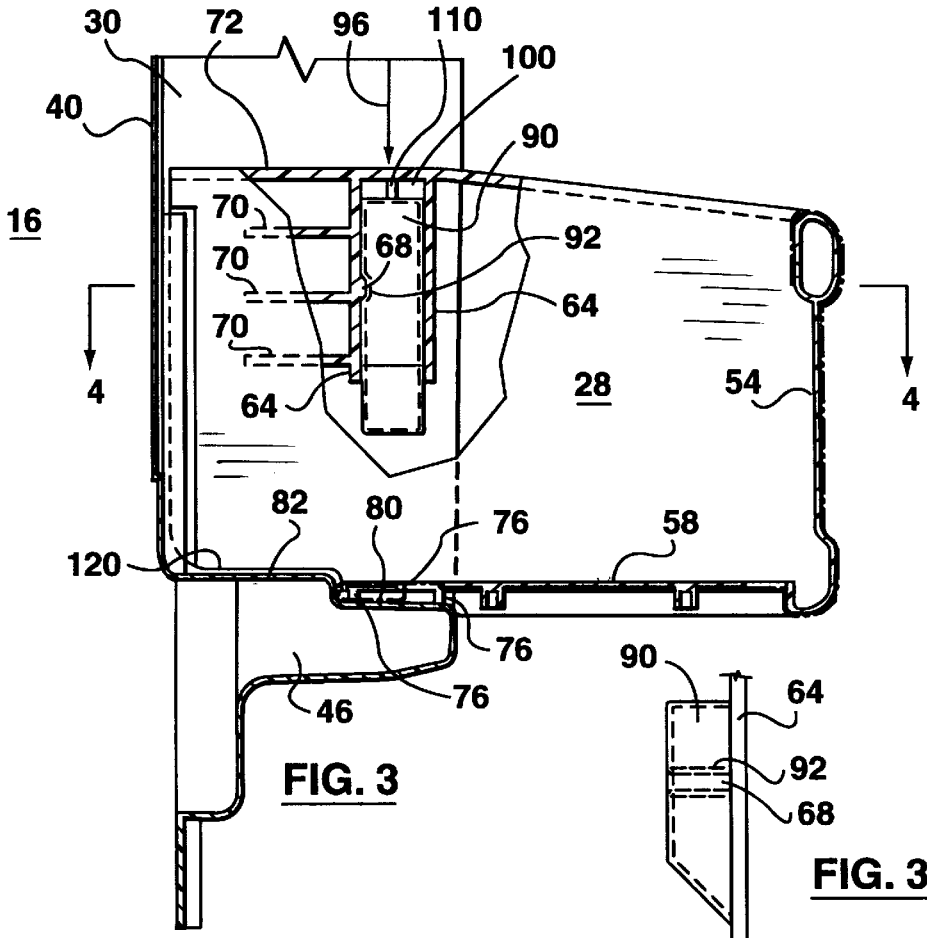
FIG. 3
FIG. 3A
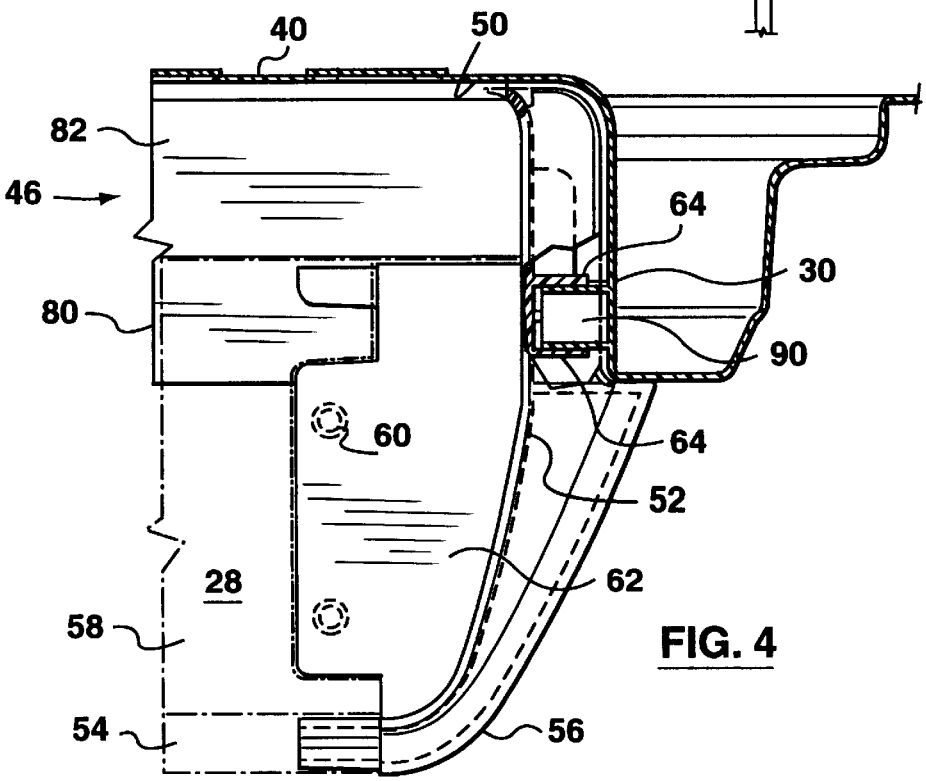
FIG. 4

REFRIGERATOR DOOR BOTTOM STORAGE MODULE ASSEMBLY

TECHNICAL FIELD OF THE INVENTION

The present invention relates to refrigerator door bottom storage module assembly that extends across the width of the bottom of the refrigerator door and, in particularly, relates to such an assembly in which the module is firmly and fixedly retained in a fully supported position in the door recess.

BACKGROUND OF THE INVENTION

Modern day refrigerators often include door mounted modules, such as bins, drawers, trays or shelves for example. They typically are used to store numerous items which are used frequently, particularly such frequently used items that are relatively small. In the past several years a number of schemes or assemblies have been introduced to provide greater flexibility by enabling the user to selectively mount different modules at numerous locations on the inner liner of the door, particularly on the fresh food compartment door. One such approach is disclosed in U.S. Pat. No. 5,370,455 issued Dec. 6, 1994 to Sedovic et al. However, this type of shelf or bin is best used in refrigerator doors having relatively narrow widths such as used in side-by-side refrigerator doors since doors of reduced width have lower loading forces placed on the shelves.

With a trend to larger refrigerators and in particular to top or bottom mount refrigerators where a door spans the entire width of the refrigerator, a middle dyke wall is located on the liner vertically extending along the center of the liner to define two adjacent recesses in the liner so that two columns of shelves may be positioned in side by side relation on the door. This distributes the shelf loading over 3 dyke side walls as compared to two dyke side walls. At the bottom of the refrigerator door, regardless of the size of the refrigerator, it has been common practice to position a permanent shelf that spans the width of the door. This shelf is either mounted as a module to the liner or integrally formed with the liner. Larger and taller articles are typically supported on the bottom storage shelf. In larger refrigerators, the loading placed on such bottom shelf is transferred directly onto the two side dyke walls of the inner liner adjacent the bottom of the liner. This increased loading may result in premature cracking of the liner wall.

The present invention provides an improved door and bottom storage module assembly which fixedly retains a module in a supported position in a recess in the door liner where the loading associated with the module is displaced over a bottom wall of the liner in addition to the side walls of the liner.

SUMMARY OF THE INVENTION

The present invention relates to a refrigerator door bottom storage module assembly extending across the refrigerator door. The assembly includes a refrigerator door having an inner liner having side walls and a bottom wall and a rear wall defining a liner recess. The bottom wall has a forward lower landing and a stepped raised landing extending into the liner recess rearwardly of the forward lower landing. The assembly has aligned module supporting bosses projecting inwardly of each of said side walls. The assembly has a door storage module having a pair of spaced apart module side walls positionable adjacent the liner side walls. The module has a front wall extending between the module side walls and a supporting floor extending rearwardly of the front wall. The module side walls have a pair of ribs projecting substantially vertically and defining an open recess. The module is assembled to the door by sliding the module ribs over the bosses until the supporting floor of the module is seated upon the forward lower landing of the bottom wall of the inner liner. Any articles supported by the bottom support module are seated upon the supporting floor of the module which at least partially rests on the forward lower landing of the bottom wall of the door inner liner. Also, the loading associated with tipping of the load is transferred through the side walls of the module onto the side walls of the inner door liner. The amount of vertical loading on the side walls is significantly less than the direct loading onto the bottom wall of the door inner liner.

In one form of the invention, the supporting floor of the module has an upper flat surface that abuts and extends flush to the stepped raised landing of the bottom wall of the inner liner when the module is assembled to said door. In this form of the invention, the loading associated with article on the bottom module of the refrigerator door results in the loading being displaced partially directly on the bottom wall of the door inner liner.

In another form of the present invention, the module side walls have a lower surface and two legs positioned below the ribs of the module side wall that are seated on the bottom wall of the inner liner when the module is assembled to the door. The legs assist in the positioning of the module relative to the bottom wall of the door liner.

In accordance with one aspect of the present invention there is provided a refrigerator door bottom storage module assembly extending across the refrigerator door including a refrigerator door having an outer shell and an inner liner including a perimeter wall projecting forward of the inner liner having side walls, a bottom wall and a rear wall defining a liner recess. The bottom wall has a forward lower landing and a stepped raised landing extending into the liner recess rearwardly of the forward lower landing. The assembly includes aligned module supporting bosses projecting inwardly of each of the side walls closely adjacent to and above the bottom wall. The assembly includes a door storage module receivable partially in the liner recess. The module includes a pair of spaced apart module side walls positionable adjacent and forward of the door liner side walls. The module includes a front wall extending between the module side walls and a supporting floor extending rearwardly of the front wall. The module side walls extend rearwardly of the supporting floor. A pair of ribs project outward of each of the module side walls and extend from adjacent a top edge of the corresponding module side wall toward a bottom of the module. Each rib defines a downward opening recess. The module is assembled to the door by sliding the module ribs down over the bosses until the supporting floor of the module is seated upon the forward lower landing of the bottom wall of the inner liner.

BRIEF DESCRIPTION OF THE DRAWINGS

For a better understanding of the nature and objects of the present invention reference may be had to the following detailed description when taken in conjunction with the accompanying diagrammatic drawings wherein:

FIG. 3 is a side sectional view of the storage module;

FIG. 3*a* is a sectional view of the rib connection to the boss of the liner side wall; and, FIG. 4 is top sectional view taken along line 4—4 of FIG. 3.

DETAILED DESCRIPTION OF EMBODIMENTS

Figure 1:
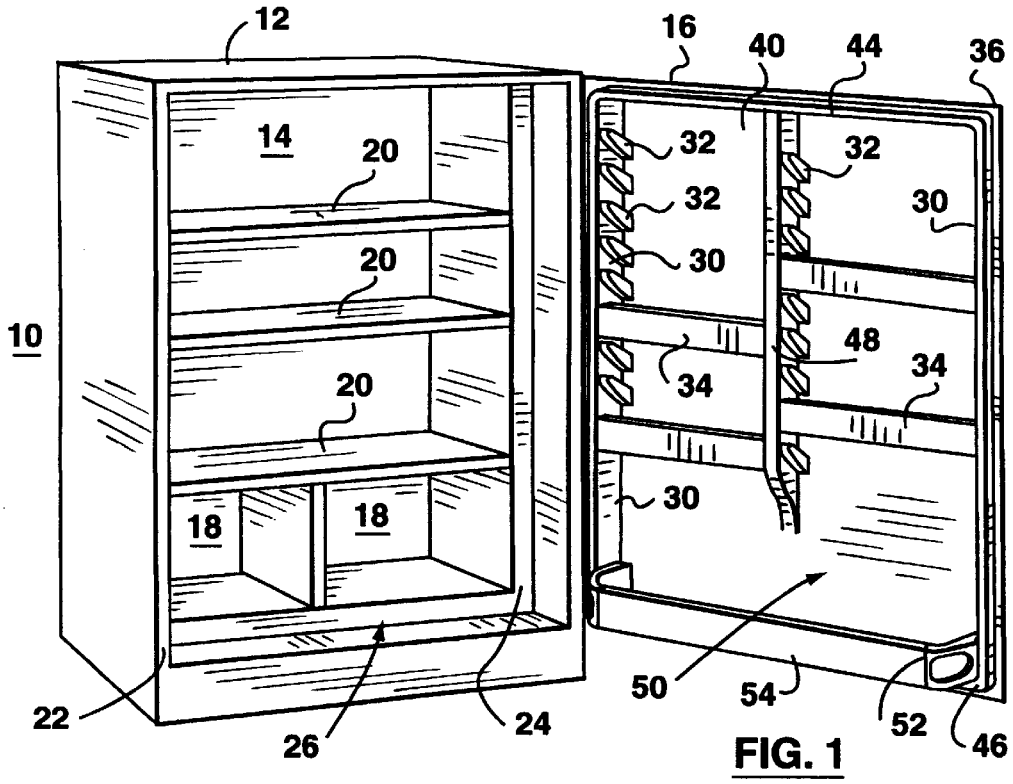
FIG. 1 is a perspective view of a refrigerator having a door bottom storage module assembly of the present invention.

Referring now particularly to FIG. 1, there is shown a refrigerator 10. Typically the refrigerator 10 includes either a top mounted or bottom mounted freezer (not shown). The refrigerator has a cabinet 12 that encloses a fresh food compartment 14. The compartment 14 includes a front access opening which normally is closed by hinged door 16. Typically drawer compartments 18 and shelves 20 are provided in the fresh food compartment 14 to support various items to be refrigerated. The fresh food compartment 14 includes an outer shell or casing 22 and an inner liner 24. The space between shell 22 and liner 24 is filled a suitable insulation material, such as, for example, a body of foamed in place insulation. A gasket (not shown) extends around the periphery of the door to seal against air leakage when the door is closed.

The open front of the cabinet 22 in front of the cabinet liner 24 includes a door recess 26 into which door 16 moves to close the front of the cabinet 22. Such door recesses often are utilized to store items mounted on the door which are not too bulky and particularly those items which are used frequently.

In the illustrative door 16, the bottom storage module 28 of the present invention is mounted across the bottom of the door to store tall items. In the present invention, the bottom storage module is mounted fixedly onto the door 16 so that it is not readily removable. The door 16 has liner side walls 30 each provided with a series of vertically spaced apart ribs 32. Modular bins or shelves 34 are supported on the door 16 above the bottom storage module 28 to store smaller items.

Door 16 comprises an outer door shell 36 and an inner door liner 40. Typically the outer door shell 36 is made up of a thin metallic material and the door liner 40 is made from a plastic liner material. The door liner 40 includes a perimeter wall which comprises a top wall 44, side walls 30 and a bottom wall 46. The liner further includes an intermediate wall 48 that divides recess 50 into two recesses into which the shelves 34 are mounted. The space between the door liner 40 and the door shell 36 is filled with foam material to provide thermal insulation.

Figure 2:
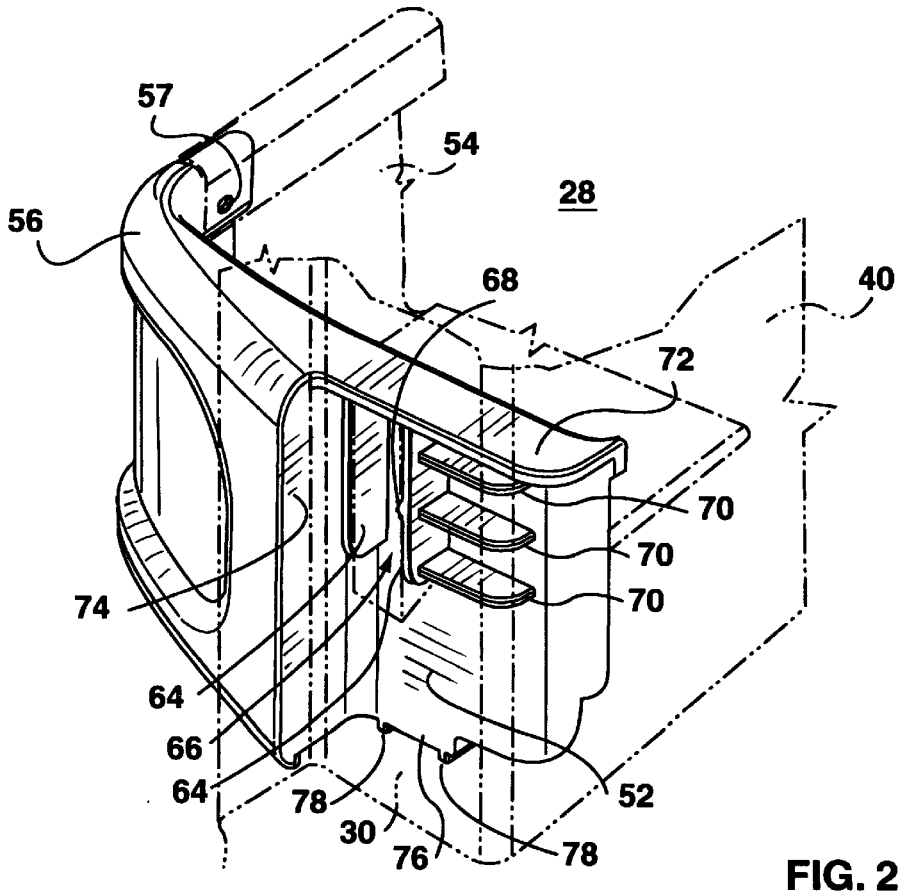
FIG. 2 is a corner perspective view storage module.

Referring now to FIGS. 2 through 4, the bottom storage module 28 is described. The door storage module 28 includes a pair of spaced apart module side walls 52. The module side walls 52 include a front wall or rail 54 attached to a corner section 56 by suitable rivets 57. The front wall 54 spans the refrigerator door 16 between frontwall section of the corner sections 56 and the side walls 52. The bottom storage module 28 further includes a supporting floor 58 mounted by rivets 60 to a floor section 62 of the corner section 56. With the assembly of the side wall 52 to the front wall 54 and the supporting floor 58, a composite module piece is assembled. This module 28 is then inserted in a secured manner to the door liner 40.

The side walls 52 of the storage module 28 include two spaced apart downwardly and vertically extending ribs 64. Each of the ribs 64 define between them a downwardly open recess 66. One of the ribs has a tab 68 which projects slightly into the open recess 66 between the ribs 64. This same rib has a series of three reinforcing ribs 70 that extend orthogonal to the rib 64. The side wall 52 further includes a top ledge 72 from which downwardly depend the side ribs 64. The side wall 52 further includes a wall 74 which is adapted to pass around a forward section of the liner side wall 30. The module side wall 52 further includes a base portion 76 having two legs 78 which are vertically aligned with and extend below the ribs 64.

The bottom wall 46 of the door liner 40 comprises a forward lower landing 80 and a stepped raised landing 82 extending towards the liner recess 50 rearwardly of the forward lower landing 80. The liner side walls 30 of the door liner 40 include two rectangular shaped vertically elongate bosses 90 that extend inwardly of the liner side wall 30 adjacent to and above the bottom wall 46. The bosses 90 have a detent or recess 92.

During the assembly of the module 28 onto the door liner 40 of the door 16, the module is inserted into the recess 50 above the boss 90. The ribs 62 are then positioned on either side of the boss 90. The module 28 is moved in the direction of arrow 96. As the module 28 is lowered, the ribs 64 slide over corresponding vertical surfaces of the boss 90 until the legs 78 of the base portion 76 of the supporting floor 58 of the module 28 contact the forward landing 80 of the bottom wall 46. In this position, the module 28 has a portion of its forward lower supporting floor 58 abutting or seated upon the forward lower landing 80 of the bottom wall 46. The top surface 98 of the supporting floor 58 is substantially flush with the surface of raised landing 82 of the bottom wall 46. Consequently any food articles placed into the modular assembly are supported by the bottom wall 46 directly in contact with the raised stepped landing 82 and indirectly on the forward landing 80 through the supporting floor 58 of the module 28.

It should be further understood that the ribs 46 are not, vertically loaded when articles are placed in the module 28. However, the ribs 46 with their sliding abutment with the boss 92 in a vertical direction, prevent module 28 from tipping as a result of the weight associated with the articles placed in the module 28 leaning forward of the bottom wall 46.

During the assembly of the module 28 into the door liner 40 the tab 68 of the rib 64 snaps into the recess 92 of the side wall 30. The purpose of this matting arrangement is to fixedly secure the module 28 relative to the side walls 30 so as to prevent the module 28 from moving in a direction opposite to the arrow 96. The spacing of the relative location of the tab 68 is chosen such that legs 78 sit on the forward landing 80 of the bottom wall 46 in the vertical direction. When assembled, the module produces a gap 100 between the top ledge 72 of the module 28 and the top surface of boss 90 so that there is relatively low vertical loading of boss 90 by module 28. In the preferred embodiment shown, the upper ledge 72 of the side wall 52 includes a stop rib 110 located in the gap 100. Stop 110 further locates the position of the ribs 64 relative to the boss 90 and translates load associated with articles positioned in the module 28 onto the side walls 30 of liner 40. However, the vertical loading forces is considered to be significantly less than any vertical loading placed on the bottom wall 46 of the refrigerator liner 40. The primary functions of bosses 90 are to fixedly locate the module 28 relative to the bottom liner wall 46 and to support module 28 against shelf loading forces that pull the module 28 relative to the liner side wall 30 in directions other than that a vertical direction shown by arrow 96.

It should be understood that the corner section 56 and the side walls 52 of the modular storage assembly 28 may comprise a molded plastic material. Further, the front wall portion 54 and the forward supporting floor 58 may comprise either a plastic or metal material. Also, the supporting floor 58 extends rearwardly from the front wall 54 a distance less then the distance of the module side wall 52. The module side wall 52 includes a stepped supporting wall 120 that is adapted to be seated upon the raised landing 82.

It will be appreciated that alternative embodiments falling within the scope of the present invention may be apparent to those skilled in the art of refrigerator door construction and accordingly the present invention should not be limited to those embodiments herein described.

What is claimed is:

1. A refrigerator door bottom storage module assembly extending across a refrigerator door including:

the refrigerator door having an outer shell and an inner liner including a perimeter wall projecting forward of the inner liner having side walls, a bottom wall and a rear wall defining a liner recess, the bottom wall having a forward lower landing and a stepped raised landing extending into the liner recess rewardly of the forward lower landing;

aligned module supporting bosses projecting inwardly of each of said side walls closely adjacent to and above the bottom wall;

door storage module receivable partially in the liner recess, said module including a pair of spaced apart module side walls positionable adjacent and forward of said door liner side walls, said module including a front wall extending between said module side walls and a supporting floor extending rearwardly of the front wall, said module side walls extending rearwardly of said supporting floor, and the module including opposing corner sections including the module side walls and a portion of the front wall and supporting floor, the front wall being connected to the front wall portions of the corner sections and the supporting floor being connected to and resting on the supporting floor portion of the corner section;

a pair of ribs projecting outward of each of said module side walls and extending from adjacent a top edge of the corresponding module side wall toward a bottom of said module; each pair of ribs defining a downward opening recess; and, whereby said module is assembled to said door by sliding said module ribs down over said bosses until the supporting floor of said module is seated upon the forward lower landing of the bottom wall of the inner liner.

2. The refrigerator door bottom storage module assembly of claim 1 wherein the bosses are rectangular in shape and the ribs of said module vertically abut said bosses as the module is assembled to said door.

3. The refrigerator door bottom storage module assembly of claim 1 wherein the supporting floor of the module has an upper flat surface that abuts and extends flush to the stepped raised landing of the bottom wall of the inner liner when the module is assembled to said door.

4. The refrigerator door bottom storage module assembly of claim 1 wherein the ribs of the side walls extend vertically.

5. A refrigerator door bottom storage module assembly extending across a refrigerator door including:

the refrigerator door having an outer shell and an inner liner including a perimeter wall projecting forward of the inner liner having side walls, a bottom wall and a rear wall defining a liner recess, the bottom wall having a forward lower landing and a stepped raised landing extending into the liner recess rearwardly of the forward lower landing;

aligned module supporting bosses projecting inwardly of each of said side walls closely adjacent to and above the bottom wall;

a door storage module receivable partially in the liner recess, said module including a pair of spaced apart module side walls positionable adjacent and forward of said door liner side walls, said module including a front wall extending said module side walls and a supporting floor extending rearwardly of the front wall, said module side walls extending rearwardly of said supporting floor;

a pair of ribs projecting outward of each of said module side walls and extending from adjacent a top edge of the corresponding module side wall toward a bottom of said module; each pair of ribs defining a downward opening recess; and, whereby said module is assembled to said door by sliding said module ribs down over said bosses until the supporting floor of said module is seated upon the forward lower landing of the bottom wall of the inner liner and each of the bosses having a vertical wall with a detent, and the rib of the module sliding over the vertical wall having a tab that snaps into the detent fixedly assembling the module to the door liner.

6. The refrigerator door bottom storage module assembly of claim 5 wherein the supporting floor of the module has an upper flat surface that abuts and extends flush to the stepped raised landing of the bottom wall of the inner liner when the module is assembled to said door.

7. The refrigerator door bottom storage module assembly of claim 5 wherein the rib having the tab has reinforcing ribs extending orthogonally along the module side wall with the ends thereof integrally attached to the rib having the tab.

8. A refrigerator door bottom storage module assembly extending across a refrigerator door including:

the refrigerator door having an outer shell and an inner liner including a perimeter wall projecting forward of the inner liner having side walls, a bottom wall and a rear wall defining a liner recess, the bottom wall having a forward lower landing and a stepped raised landing extending into the liner recess rearwardly of the forward lower landing;

aligned module supporting bosses projecting inwardly of each of said side walls closely adjacent to and above the bottom wall;

a door storage module receivable partially in the liner recess, said module including a pair of spaced apart module side walls positionable adjacent and forward of said door liner side walls, said module including a front wall extending between said module side walls and a supporting floor extending rearwardly of the front wall, said module side walls extending rearwardly of said supporting floor;

pair of ribs projecting outward of each of said module side walls and extending from adjacent a top edge of the corresponding module side wall toward a bottom of said module; each pair of ribs defining a downward opening recess;

a base portion positioned below the ribs of the module side wall and a stepped supporting wall extending rearwardly and vertically spaced from the base portion;

whereby said module is assembled to said door by sliding said module ribs down over said bosses until the base portion of said module is seated upon the forward lower landing of the bottom wall of the inner liner and the stepped supporting wall is seated upon the stepped raised landing.

9. The refrigerator door bottom storage module assembly of claim 8 wherein the bosses are rectangular in shape and the ribs of said module slidingly abut said bosses as the module is assembled to said door.

10. The refrigerator door bottom storage module assembly of claim 9 wherein each of the bosses has a vertical wall with a detent, and the rib of the module sliding over the vertical wall having a tab that snaps into the detent fixedly assembling the module to the door liner.

11. The refrigerator door bottom storage module assembly of claim 10 wherein the supporting floor of the module has an upper flat surface that abuts and extends flush to the stepped raised landing of the bottom wall of the inner liner when the module is assembled to said door.

12. The refrigerator door bottom storage module assembly of claim 10 wherein the rib having the tab has reinforcing ribs extending orthogonally along the module side wall with the ends integrally attached to the rib having the tab.

13. The refrigerator door bottom storage module assembly of claim 8 wherein the supporting floor of the module is seated upon the forward lower landing of the bottom wall of the inner liner, said supporting floor has an upper flat surface that abuts and extends flush to the stepped raised landing of the bottom wall of the inner liner when the module is assembled to said door.

14. The refrigerator door bottom storage module assembly of claim 8 wherein the module includes opposing corner sections including the module side walls and a portion of the front wall and supporting floor walls, a front wall connected to the front wall portions of the corner sections and a supporting floor wall portion connected to and resting on the supporting floor walls of the corner section.

15. The refrigerator door bottom storage module assembly of claim 8 wherein the base support of the module side walls each have two legs that are seated on the bottom wall of the inner liner when the module is assembled to the door.

16. The refrigerator door bottom storage module assembly of claim 8 wherein the ribs of the side walls extend vertically.

* * * * *

UNITED STATES PATENT AND TRADEMARK OFFICE

CERTIFICATE OF CORRECTION

PATENT NO. : 6,231,146 B1
DATED : May 15, 2001
INVENTOR(S) : Dang

It is certified that error appears in the above-identified patent and that said Letters Patent is hereby corrected as shown below:

Column 5,
Line 22, insert "a" before door.

Column 6,
Line 8, insert "between" after extending.
Line 54, insert "a" before pair.

Drawings,
Formal Drawings received by the Patent Office on October 25, 2000 for Figs. 1 to 4 were not published.

Signed and Sealed this

Twenty-ninth Day of January, 2002

*Attest:*

*Attesting Officer*

JAMES E. ROGAN
*Director of the United States Patent and Trademark Office*